US005442600A

United States Patent [19]

Kutosky

[11] Patent Number: 5,442,600

[45] Date of Patent: Aug. 15, 1995

[54] SNOOZE-TIMER DEVICE

[76] Inventor: Thomas H. Kutosky, Ten Barrington Dr., Pittsburgh, Pa. 15209

[21] Appl. No.: 88,840

[22] Filed: Jul. 8, 1993

[51] Int. Cl.[6] ..... G04F 8/00; B04B 23/00

[52] U.S. Cl. ..... 368/109; 368/263

[58] Field of Search ..... 368/107-113, 368/250, 251, 262-263

[56] References Cited

U.S. PATENT DOCUMENTS

| | | | |
|---|---|---|---|
| 4,079,583 | 3/1978 | Larsen | 368/108 |
| 4,092,822 | 6/1978 | Droz et al. | 368/187 |
| 4,236,237 | 11/1980 | Ichikawa | 368/66 |
| 4,316,276 | 2/1982 | Koehler et al. | 368/70 |
| 4,407,587 | 10/1983 | Fujita | 368/108 |
| 4,415,273 | 11/1983 | Hoffman et al. | 368/74 |
| 4,421,418 | 12/1983 | Morishima | 368/187 |
| 4,526,479 | 7/1985 | Harris | 368/284 |
| 4,632,570 | 12/1986 | Kelsey | 368/107 |
| 4,690,566 | 9/1987 | Robertsen | 368/108 |
| 4,742,501 | 5/1988 | Coster | 368/82 |
| 4,783,773 | 11/1988 | Houlihan et al. | 368/108 |
| 4,855,971 | 8/1989 | Meisner et al. | 368/182 |

FOREIGN PATENT DOCUMENTS 0436480 7/1991 European Pat. Off. .

OTHER PUBLICATIONS

"Parking Meter Timer", Electronics Today, vol. II No. 1, Jan. 1982 pp. 29-31.

Service Merchandise Catalog, p. 161, 1993.

*Primary Examiner*—Vit W. Miska

*Attorney, Agent, or Firm*—Buchanan Ingersoll; Lynn J. Alstadt

[57] ABSTRACT

A timer device utilized both as an individual snooze-timer and in a conventional alarm clock having a snooze mode which allows for the selection of an uninterrupted snooze time period. The length of the snooze time period is selected by the user and is preferably up to 90 minutes. The individual snooze-timer device includes a housing having a display unit and a button-type switch, a central processing unit, a clock, and a memory. Preferably, the central processing unit, clock and memory are contained in a single microprocessor chip.

20 Claims, 2 Drawing Sheets

SNOOZE-TIMER DEVICE

FIELD OF INVENTION

The present invention relates to a timer device used both as an individual,snooze alarm and in a conventional alarm,, clock having a snooze mode.

BACKGROUND OF INVENTION

Various prior art alarm clocks include a snooze mode which enables the person to go back to sleep after the alarm has sounded and be awakened after a predetermined amount of time such as five, eight or nine minutes. If the person would like to sleep for a longer period than the predetermined time, he must reset the snooze mode each time the predetermined time has elapsed and the alarm sounds. For instance, if an alarm clock has a predetermined snooze time of five minutes, in order for the person sleeping to snooze for 15 minutes after the alarm initially sounds, the person must be repeatedly awakened in order to depress a snooze button. When the original alarm initially sounds the snooze button must be depressed. After five minutes, the alarm will sound again and the snooze button must be depressed a second time. After 10 minutes have elapsed from the original alarm sounding, the alarm will sound and the snooze button must be depressed a third time. After 15 minutes have elapsed from the sounding of the original alarm, the snooze alarm will sound a fourth time indicating that the 15 minute nap has ended. Thus, the prior art alarm clocks do not provide uninterrupted snooze time for a time interval longer or shorter than the time predetermined by the clock manufacturer.

SUMMARY OF THE INVENTION

I provide a snooze-timer device which enables the user to select the length of time he wishes to sleep beyond the alarm time. My first present preferred embodiment is an individual snooze-timer device having a time display unit, a button-type switch, an alarm and a microprocessor chip. The button-type switch, display unit and alarm are connected to the microprocessor chip. The chip includes a central processing unit, a clock, and a memory. The memory contains a program which allows the user to select an alarm time of up to 90 minutes chosen in five minute increments using the button-type switch. Although my present preferred embodiment has a maximum snooze time of 90 minutes, a greater or lesser amount of time can be chosen. Likewise, an increment of time other than live minutes can be chosen to adapt my snooze-timer device to the user's need.

I prefer to display the remaining snooze time on the display unit when the remaining snooze time is less than one minute so as to alert a person that the alarm will shortly sound. The display unit further includes a battery low indicator as well as a snooze countdown indicator.

In a second preferred embodiment my snooze-timer device is incorporated into a conventional alarm clock or clock radio. A dual display window is provided. A first display window displays the time of day and a second display window displays the remaining snooze time.

Other objects and advantages of the invention will become apparent from a description of the present preferred embodiments shown in the accompanying drawings.

BRIEF DESCRIPTION OF THE DRAWINGS

In the accompanying drawings I have shown certain present preferred embodiments of the invention in which.

DETAILED DESCRIPTION OF THE DRAWINGS

Figure 1:
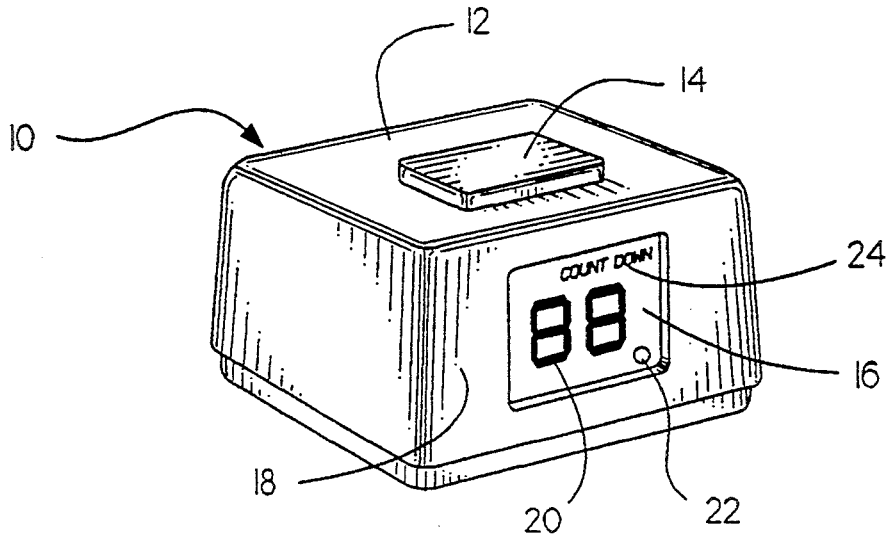
FIG. 1 shows a perspective view of a first present preferred embodiment of my snooze-timer device.
Figure 2:
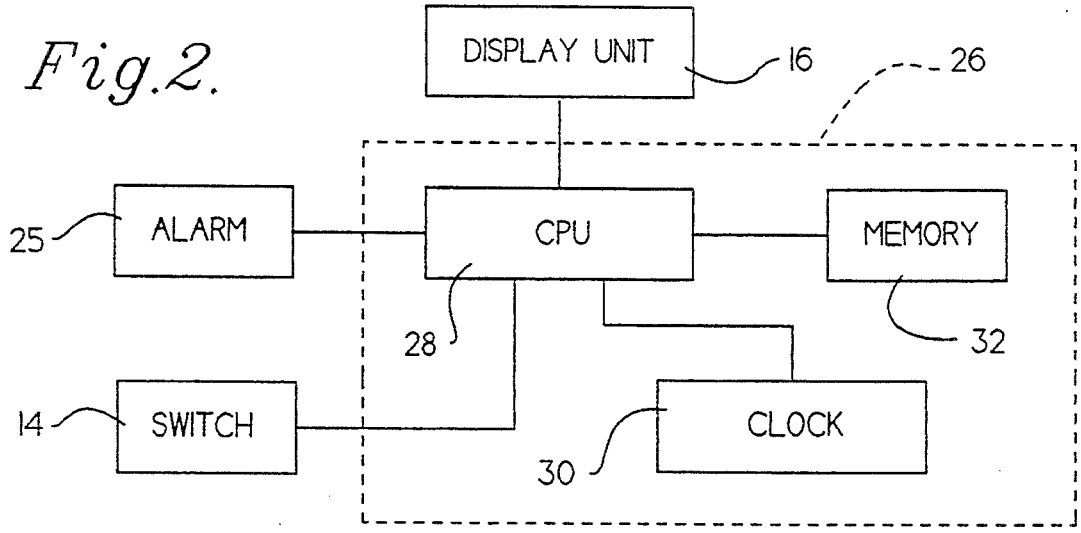
FIG. 2 is a block diagram showing the best electronic components used in the snooze-timer device of FIG. 1.
Figure 3:
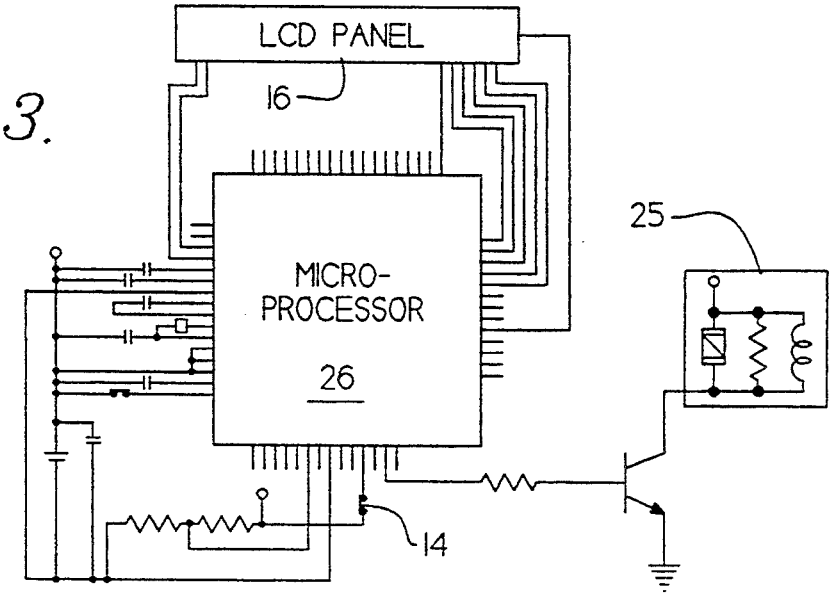
FIG. 3 is a circuit diagram of the snooze-timer device of FIG. 1.

Reference is ! directed to FIGS. 1 thru 3 which illustrate a first present preferred embodiment of my individual snooze-timer device 10 including a housing 12 having a single depressable button-type switch 24 and a display unit 16 located on one of the six surfaces 18 of the housing 12. The display unit 16 is preferably a liquid crystal display (LCD) having a two digits read out 20, a battery low indicator 22 and a countdown indicator 24. The display can also take the form of an "LED" (light emitting diode) or other display technology.

The housing 12 encases an alarm 25 and a microprocessor chip 26. As indicated in FIG. 2, the microprocessor chip 26 contains a central processing unit (CPU) 28, a clock 30 and a memory 32. The clock can be a crystal oscillator. I have found that the following commercially available components can be used:

| Part | Part No. | Source | Ref. # |
|---|---|---|---|
| Button-Type Switch | MWK-11E00G1 | Chartrick | 14 |
| LCD Display Unit | AE-1286 | EPSON | 16 |
| Alarm | EZB 27B0001 | Tinmex | 25 |
| Microprocessor | SMC 4151 | Paragon Electronics | 26 |

Because of the simplicity of this embodiment, it can be as small as a 2 inch cube. Thus, it is lightweight and will easily fit in a suitcase, briefcase or even a pocket. One could also make this device to be only slightly larger than a credit card. Thus, it is very useful as a travel timer.

The memory 32 of microprocessor chip 26 contains a program which preferably enables the individual snooze-timer device 30 to work in the following manner. At the initial depression of the single depressable button-type switch 14, the display unit 16 will be illuminated so that the snooze time displayed can be read during night and dark situations. The display unit 16 will indicate the clock 30 being set to "5" (5 minutes). When the button-type switch 14 is depressed a second time, the snooze time will advance in five minute increments thus, displaying "10" (ten minutes) on the display unit 16. The button-type switch 14 can be depressed consecutively in order to select a snooze time up to 90 minutes chosen in five minute increments, for instance, 5, 10, 15, 20 . . . 80, 85, 90 minutes once the snooze time is set, the countdown indicator 24 will be illuminated and begin flashing indicating that the snooze-timer device 10 has begun counting down.

After the snooze time is set and ten seconds have elapsed, depression of the button-type switch 14 for approximately two seconds will cause the selected snooze time to be cancelled and the snooze-timer device 10 to be reset. This allows the person sleeping to reset the snooze-timer device 10 if he has made a mistake in selection of snooze time as well as cancel the snooze-timer alarm 25 all together.

Once the snooze time is set and ten seconds have elapsed, the illumination of the display unit 16 will cease. When the snooze time remaining is less than one minute the remaining snooze time will be displayed in unit of seconds and will countdown from 59 seconds to 0 seconds at which time the alarm 25 will sound indicating the selected snooze time has elapsed. When the alarm 25 sounds it will preferably sound at two kilohertz for 90 seconds. The sounding alarm 25 can be turned off by depressing the button-type switch 14 for approximately two seconds.

The battery low indicator 22 is illuminated when the battery voltage falls below 1.2 volts. The LCD display unit 16 can function with a power source of 1.3 volts, however, a 3 volt battery is preferable. Optionally, the individual snooze-timer device 10 can be adapted to be used with an AC power source.

Figure 4:
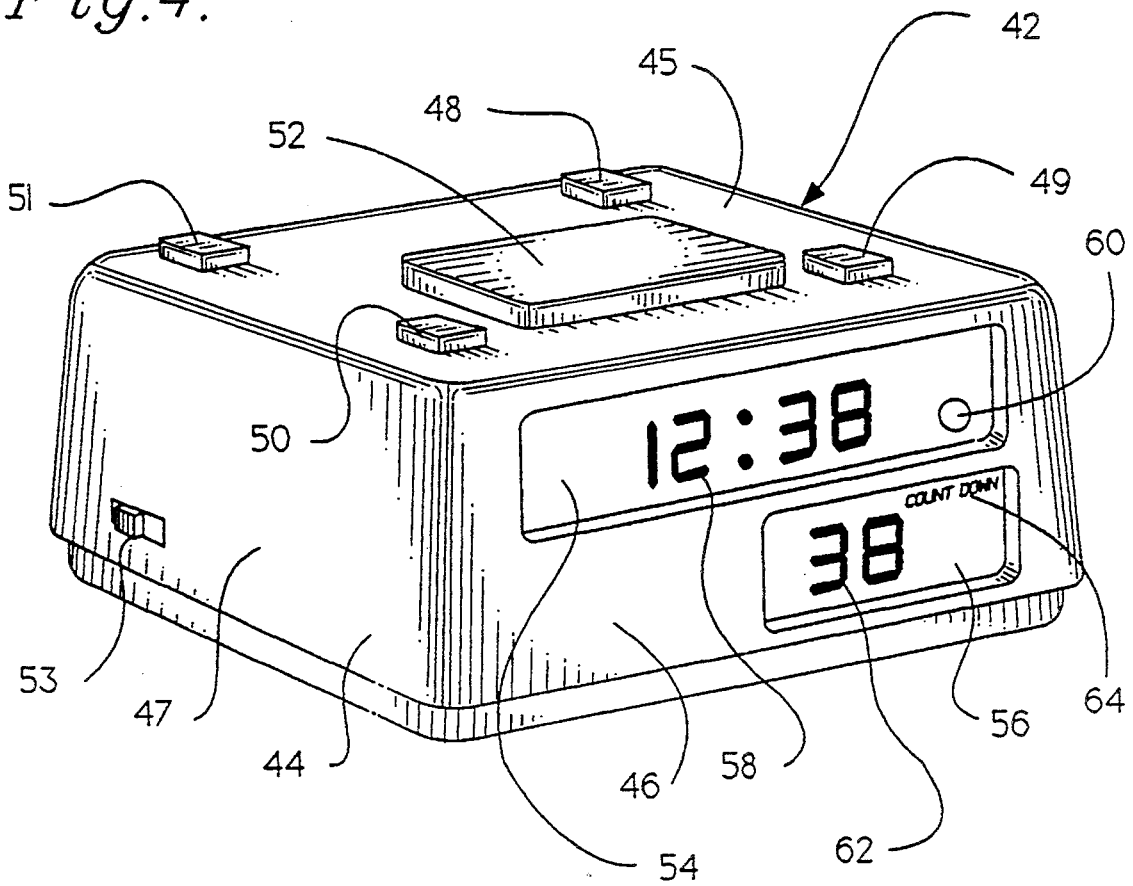
FIG. 4 is a perspective view of a second preferred embodiment of my snooze-timer device.

FIG. 4 illustrates a second embodiment in which my snooze-timer device is incorporated in an alarm clock 42 having a housing 44 with a top surface 45, a front surface 46 and a side surface 47. The top surface 45 of the housing 44 includes five input control buttons 48, 49, 50, 51 and 52. An alarm on/off switch 53 is positioned on the side surface 47. The control buttons 48 thru 52 are labeled "hour", "minute", "alarm", "time" and "snoozer", respectively. The "snoozer" button 52 is substantially larger than the other buttons such that the "snoozer" button 52 is easily identified and contacted. Although not illustrated, the hour button 48 and minute 49 button can be replaced by a turn dial in order to set the alarm, time of day and snooze time.

The housing 44 further includes the front surface 46 having a dual window display unit with a first display window 54 and a second display window 56 each preferably being liquid crystal display (LCD). The first display window 54 includes a four digit read out 58 and a battery low indicator 60. The second display window 56 has a two digit read out 62 and a snooze-countdown indicator 64. The snooze-countdown indicator 64 will flash once the snooze-time is set to indicate countdown of the selected snooze time has begun..

Figure 5:
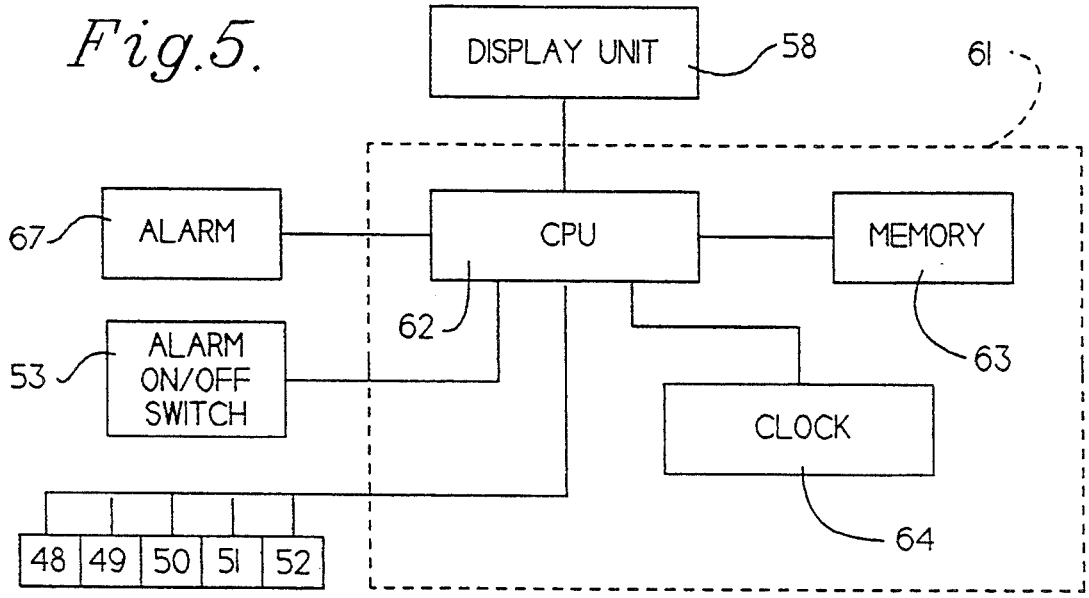
FIG. 5 is a block diagram of the basic electronic components used in the embodiment of FIG. 4.

The housing 44 encases the conventional contents of an alarm clock and a microprocessor chip 61. Referring to FIG. 5, microprocessor chip 61 contains a central processing unit 62, a memory 63, and a clock 64. An alarm 67, alarm on/off switch 53 and five input control buttons 48 thru 52 are connected to the central processing unit 62 which controls the display unit 58.

The memory of the microprocessor chip 61 is programmable such that the snooze time of the improved alarm clock 42 is set similarly to the setting of the individual snooze-timer device 10 shown in FIGS. 1 thru 3. The "snoozer" button 52 is illuminated when the initial alarm sounds and remains illuminated for ten seconds after the selected snooze time has been set. Each additional depression of the "snooze" button 52 will advance the snooze time in five minute increments. Once the snooze time is selected it will be shown on the second display unit 56. After two seconds have elapsed the countdown of the snooze time will commence and the countdown will be indicated by the flashing snooze-countdown indicator 64. When the snooze time is less than one minute the remaining snooze time in units of seconds will be shown on the second display window 56.

If the person wants to prevent the snooze-timer alarm 67 from sounding before the selected snooze time has elapsed for whatever reason he can do so by depressing the "snoozer" button 52 for approximately two seconds which will reset the snooze mode. The countdown Of the snooze-timer can also be stopped by moving the alarm on/off switch 53 to the off position.

My snooze-timer can be utilized where it is necessary to measure a period without repeated resetting of the clock. Particularly, my snooze-timer device may be utilized as a timer for naps as well as a home or office timer/reminder. Further, my snooze-timer can be a stand alone unit or utilized in a conventional alarm clock or clock radio to provide therewith a snooze mode enabling a person to select a snooze time of uninterrupted sleep.

Although I have described and shown certain present preferred embodiments of my invention it should be distinctly understood that the invention is not limited thereto, but may be variously embodied within the scope of the following claims.

I claim:

1. A timer device comprising:

a ) a housing;

b) only one button-type switch attached to the housing;

c) a time display unit attached to the housing;

d) an alarm being positioned within the housing;

e) a clock positioned within the housing;

f) a central processing unit positioned within the housing and electrically connected to the time display unit, the button-type switch, the alarm and the clock; and g) memory means positioned within the housing and electrically connected to the central processing unit, the memory means containing a program which enables a user to set the alarm to sound at the end of a time period selected by the user which selection is made by depressing the button-type switch a number of times which corresponds to the time period selected by the user the time period being the number of times multiplied by a selected time interval and which program causes the selected time period to be displayed on the display unit where each depression of the switch is for a first length of time, the memory means program further providing that depression of the button-type switch once for a second length of time will reset the timer device.

2. The timer device of claim 1 also comprising:

a) a battery connected to the central processing unit;

b) a low battery detection circuit; and c) a low battery indicator located on the display unit and illuminated when the low battery detection circuit detects the battery voltage being below a preselected level.

3. The timer device of claim 1 wherein the clock, the central processing unit and the memory are contained within a single microprocessor chip.

4. The timer device of claim 1 wherein the display unit includes a countdown indicator and the program enables the display unit to display any time remaining in the selected time period.

5. The timer device of claim 4 wherein the program causes the time remaining in the selected time period to be displayed on the display unit in units of minutes and in units of seconds when the time remaining in the selected time period is less than one minute.

6. The timer device of claim 1 wherein the program enables both the display unit to be illuminated and the alarm to be reset to five minutes substantially simultaneously with the initial depression of the button-type switch.

7. The timer device of claim 1 also comprising an on/off switch and input control buttons for minute, hour and time set within the housing.

8. An improved alarm clock of the type being connectable to a power source and having an alarm on/off switch and four input control buttons, the four input control buttons are depressed for minute, hour, time set and alarm set, the improvement including a timer device comprising:

a) a housing;

b only one button-type switch attached to the housing;

c) a time display unit attached to the housing;

d) an alarm being positioned within the housing;

e) a clock positioned within the housing;

f) a central processing unit positioned within the housing and electrically connected to the time display unit, the button-type switch, the alarm and the clock; and g) memory means positioned within the housing and electrically connected to the central processing unit, the memory means containing a program which enables a user to set the alarm to sounds at the end of a time period selected by the user which selection is made by depressing the button-type switch a number of times which corresponds to the time period selected by the user and which program causes the selected time period to be displayed on the display unit where each depression of the switch is for a first length of time, the memory means program further providing that depression of the button-type switch once for a second length of time will reset the timer device, and the memory means further providing a time period following the last depression of the button-type switch for the first period of time and preceding the depression of the button-type switch for the second period of time during which depression of the button-type switch will have no effect, so that the timer device is not inadvertently reset.

9. The timer device of claim 8 wherein the time display unit includes a dual display window having a first display window displaying the time of day and a second display window displaying any time remaining in the selected time period.

10. The timer device of claim 9 wherein the second display window includes a snooze-countdown indicator and the program enables the second display window to display any time remaining in the selected time period.

11. The timer device of claim 10 wherein the program causes any time remaining in the selected time period to be displayed on the second display window in units of seconds when the time remaining in the selected time period is less than one minute.

12. The timer device of claim 9 wherein the program provides for the second display window to be illuminated when the time remaining in the selected time period is less than one minute.

13. The timer device of claim 12 wherein the button-type switch is able to be illuminated and the program provides for the button to be illuminated after the alarm sounds initially.

14. The timer device of claim 9 wherein the program enables both the second display window to be illuminated and the alarm to be reset to five minutes substantially simultaneously with the initial depression of the button-type switch.

15. The timer device of claim 9 wherein the second display window includes a snooze-countdown indicator and the program causes the snooze-countdown indicator to flash when the selected time period is set.

16. The timer device of claim 8 wherein the clock, central processing unit and memory are contained within a single microprocessor chip.

17. The timer device of claim 8 wherein the time period selected by the user is the number of times which the user has depressed the button-type switch multiplied by a selected time interval.

18. The timer device of claim 8 wherein the program enables the alarm when sounding to be shut off by one of switching the alarm on/off switch from an on position to an off position and pressing the button-type switch for approximately two seconds.

19. The timer device of claim 8 wherein the button-type switch is substantially larger than the four input control buttons.

20. A timer device comprising:

a) a housing;

b) only one button-type switch attached to the housing;

c) a time display unit attached to the housing;

d) an alarm being positioned within the housing;

e) a clock positioned within the housing;

f) a central processing unit positioned within the housing and electrically connected to the time display unit, the button-type switch, the alarm and the clock; and g) memory means positioned within the housing and electrically connected to the central processing unit, the memory means containing a program which enables a user to set the alarm to sound at the end of a time period selected by the user which selection is made by depressing the button-type switch a number of times which corresponds to the time period selected by the user and which program causes the selected time period to be displayed on the display unit where each depression of the switch is for a first length of time, the memory means program further providing that depression of the button-type switch once for a second length of time will reset the timer device, and the memory means further providing a time period following the last depression of the button-type switch for the first period of time and preceding the depression of the button-type switch for the second period of time during which depression of the button-type switch will have no effect, so that the timer device is not inadvertently reset.

* * * * *